US009863637B2

(12) United States Patent
Takiguchi et al.

(10) Patent No.: US 9,863,637 B2
(45) Date of Patent: Jan. 9, 2018

(54) COMBUSTOR

(75) Inventors: Satoshi Takiguchi, Hyogo (JP); Atsushi Yuasa, Hyogo (JP); Satoshi Tanimura, Hyogo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 757 days.

(21) Appl. No.: 13/266,652

(22) PCT Filed: Aug. 13, 2009

(86) PCT No.: PCT/JP2009/064298

§ 371 (c)(1),
(2), (4) Date: Oct. 27, 2011

(87) PCT Pub. No.: WO2011/018853

PCT Pub. Date: Feb. 17, 2011

(65) Prior Publication Data

US 2012/0045725 A1 Feb. 23, 2012

(51) Int. Cl.
*F23Q 9/08* (2006.01)
*F23R 3/14* (2006.01)
(Continued)

(52) U.S. Cl.
CPC ..... *F23R 3/14* (2013.01); *F23R 3/16* (2013.01); *F23R 3/26* (2013.01); *F23R 3/286* (2013.01);
(Continued)

(58) Field of Classification Search
CPC ..... F23R 3/04; F23R 3/16; F23R 3/26; F23R 3/54; F23R 3/286; F23R 3/343; F23R 3/24; F23R 3/06; F23R 3/08; F23D 2900/11401
(Continued)

(56) References Cited

U.S. PATENT DOCUMENTS 3,792,582 A * 2/1974 Markowski ..... 60/737
3,952,501 A 4/1976 Saintsbury
(Continued)

FOREIGN PATENT DOCUMENTS

CN 1464959 A 12/2003
CN 101050867 A 10/2007
(Continued)

OTHER PUBLICATIONS

Chinese Office Action dated Aug. 21, 2013, in corresponding Chinese Application No. 200980159275.7 w/English Translation. (16 pages).
(Continued)

*Primary Examiner* — Jason Lau
(74) *Attorney, Agent, or Firm* — Westerman, Hattori, Daniels & Adrian, LLP

(57) ABSTRACT

Provided is a combustor that is made compact and achieves NOx reduction. In the combustor (1) including a pilot nozzle (21) disposed along the central axis of the combustor (1) and performing diffusion combustion, a plurality of main nozzles (22) disposed on the outer peripheral side of the pilot nozzle (21) at intervals in the circumferential direction and performing premixing combustion, a single inner cylinder (2*a*) surrounding the pilot nozzle (21) and the main nozzles (22), and an outer cylinder approximately coaxially surrounding the outer side of the inner cylinder (2*a*) to form a compressed air passage (6) between the inner peripheral surface thereof and the outer peripheral surface of the inner cylinder and turning the flow direction of compressed air flowing in the compressed air passage (6) in approximately the opposite direction at the end of the inner cylinder (2*a*) to introduce the compressed air into the pilot nozzle (21), the compressed air passage (6) is provided with a flow rate controller that makes the flow rate on the combustor (1)
(Continued)

inner peripheral side of the passage larger than that on the outer peripheral side. An example as the flow rate controller is a baffle plate 51 provided with holes 55, 56.

12 Claims, 6 Drawing Sheets

(51) Int. Cl.

| | |
|---|---|
| ***F23R 3/16*** | (2006.01) |
| ***F23R 3/26*** | (2006.01) |
| ***F23R 3/28*** | (2006.01) |
| ***F23R 3/34*** | (2006.01) |
| ***F23R 3/54*** | (2006.01) |

(52) U.S. Cl.
CPC ..... *F23R 3/343* (2013.01); *F23R 3/54* (2013.01); *F23D 2900/11402* (2013.01)

(58) Field of Classification Search
USPC ..... 431/116, 172; 60/760; 239/533.3
See application file for complete search history.

(56) References Cited

U.S. PATENT DOCUMENTS

| | | | | |
|---|---|---|---|---|
| 6,253,538 | B1 | 7/2001 | Sampath et al. | |
| 6,634,175 | B1 | 10/2003 | Kawata et al. | |
| 7,815,419 | B2 * | 10/2010 | Teraoka et al. | 416/178 |
| 8,234,872 | B2 * | 8/2012 | Berry | F23R 3/04 239/590.3 |
| 2007/0199324 | A1 | 8/2007 | Tanimura et al. | |
| 2007/0199325 | A1 * | 8/2007 | Tanimura et al. | 60/740 |
| 2007/0199327 | A1 | 8/2007 | Tanimura et al. | |

FOREIGN PATENT DOCUMENTS

| | | | | | |
|---|---|---|---|---|---|
| CN | 101055093 | A | | 10/2007 | |
| CN | 101069042 | A | | 11/2007 | |
| DE | 10 2007 009 285 | A1 | | 8/2007 | |
| EP | 1 103 767 | A1 | | 5/2001 | |
| EP | 1936468 | A1 | | 6/2008 | |
| GB | 1060026 | A | * | 2/1967 | F23R 3/04 |
| GB | 1385903 | A | | 3/1975 | |
| JP | 59-124864 | U | | 8/1984 | |
| JP | 7-198143 | A | | 8/1995 | |
| JP | 09184629 | A | * | 7/1997 | F23R 3/30 |
| JP | 2000-346361 | A | | 12/2000 | |
| JP | 2007-232348 | A | | 9/2007 | |

OTHER PUBLICATIONS

International Search Report of PCT/JP2009/064298, dated Nov. 10, 2009.

Korean Notification of Grant of Invention dated Aug. 29, 2013, issued in corresponding Korean Patent Application No. 10-2011-7026370 (3 pages). A Concise English-Language explanation of relevance is attached.

A Decision to Grant a Patent dated May 6, 2014, issued in corresponding Chinese Patent Application No. 200980159275.7 (2 pages).

Extended European Search Report dated Jul. 24, 2014, issued in corresponding European Patent Application No. 09848272.2 (6 pages).

A Decision to Grant a Patent dated Apr. 29, 2016, issued in corresponding European Patent Application No. 09848272.2.

* cited by examiner

COMBUSTOR

TECHNICAL FIELD

The present invention relates to a combustor of a gas turbine, in particular, to a combustor having a structure for reducing deflection and turbulence of airflow flowing inside the combustor.

BACKGROUND ART

Regarding measures to reduce the amount of NOx from a gas turbine combustor, it is important to control fuel distribution so as not to generate a locally high fuel concentration, and it is necessary to make the fuel concentration uniform. In order to do so, it is important to increase and uniformize the amount of main air through which the majority of fuel passes.

Previously, a combustor in which the main airflow from a combustor casing is turned by 180 degrees and guided into a main premixing nozzle has been disclosed (for example, see Patent Literature 1). In such a combustor, in order to eliminate uneven flow deflection accompanied by, for example, flow separation, uniform flow and concentration in the combustion region are achieved by disposing a baffle plate at the inlet, changing the number of turning vanes at the turning position to two, or making the distance from the fuel mixing position to the 180-degree turning position sufficiently long for rectifying the flow.

CITATION LIST

Patent Literature

{PTL 1} Japanese Unexamined Patent Application, Publication No. 2007-232348

SUMMARY OF INVENTION

Technical Problem

However, in the existing structures, the increase in length of a combustor causes increases in weight and cost, and also the complicated turning portion is not ideal for reducing the size of the combustor. On the other hand, shortening the distance from the turning portion to the fuel mixing position causes a problem in that NOx generation is increased along with an increase in deflection of the air distribution, in a trade-off relationship.

The present invention has been made in view of the above circumstances, and the object thereof is to provide a combustor that is made compact and achieves NOx reduction.

Solution to Problem

An aspect of the present invention relates to a combustor including a pilot nozzle disposed along the central axis of the combustor and performing diffusion combustion, a plurality of main nozzles disposed on the outer peripheral side of the pilot nozzle at intervals in the circumferential direction and performing premixed combustion, a single inner cylinder surrounding the pilot nozzle and the main nozzles, and an outer cylinder approximately coaxially surrounding the outer side of the inner cylinder to form a compressed air passage between the inner peripheral surface thereof and the outer peripheral surface of the inner cylinder and turning the flow direction of compressed air flowing in the compressed air passage in approximately the opposite direction at the end of the inner cylinder to introduce the compressed air into the pilot nozzle, wherein the compressed air passage is provided with a flow rate controller that makes the flow rate on the combustor inner peripheral side of the passage larger than that on the outer peripheral side of the passage.

When the holes provided in a baffle plate are uniform, the flow does not have a distribution in the radial direction of the combustor. In such a state, when the flow direction is turned in approximately the opposite direction, a low-speed region is formed at the inner side on the downstream side of the passage turnaround position due to, for example, separation. Consequently, in a structure in which the length of the combustor is short, the flow rectifying distance is shortened to show a tendency of reducing the flow rate on the inner peripheral side.

According to the aspect, the flow rate in the radial direction can be made uniform by the flow rate controller. By doing so, a flow rate distribution in the radial direction is provided, and uniformity of the main airflow rate in the radial direction in the downstream region is achieved.

In the above-mentioned aspect, the compressed air passage may be provided with a baffle plate functioning as the flow rate controller by blocking the passage, and the baffle plate may be provided with a plurality of holes communicating between the upstream side and the downstream side of the baffle plate in the passage, wherein the diameter of the holes provided on the inner peripheral side may be larger than the diameter of the holes provided on the outer peripheral side.

By thus arranging large holes and small holes in a mixed state in the baffle plate, nonuniformity in flow rate is locally generated, increasing turbulence on the downstream side of the large holes. As a result, momentum exchange is activated, and the tendency for separation at the passage turnaround is also prevented. In particular, by using a structure in which the diameter of the holes provided on the inner peripheral side of the combustor is larger than that of the holes provided on the outer peripheral side of the combustor, the flow rate in the radial direction can be made uniform.

In the above-described aspect, the baffle plate may be disposed at a position, on the upstream side of the center of the position at which the passage is turned in approximately the opposite direction, with a distance from the center not longer than 15 times the diameter of the holes provided on the inner peripheral side.

When B stands for the diameter of the holes on the inner peripheral side, the distance that maintains the core portion of a jet stream passing through the baffle plate, that is, the region in which the flow rate of the jet stream is not decreased by the influence of fresh air, is about 6 B from the baffle plate to the downstream side in a two-dimensional jet stream, and about 10 B from the baffle plate to the downstream side in a three-dimensional jet stream. Accordingly, by disposing the baffle plate at a position, on the upstream side of the center of the position at which the passage is turned in approximately the opposite direction, with a distance from the center not longer than 15 times the diameter of the holes provided on the inner peripheral side, the Coanda effect of the jet stream can be expected, and the tendency for separation on the downstream side of the passage turnaround position can be prevented.

In the above-mentioned aspect, the end of the inner cylinder may be provided with an expanding portion gradually expanding outward in the radial direction toward the downstream end of the passage, and the holes on the inner peripheral side may be disposed farther on the inner side in the radial direction than the edge of the expanding portion on the outer side in the radial direction.

By providing the inner-periphery holes farther toward the inner side in the radial direction than the edge of the expanding portion on the outer side in the radial direction, the jet streams from the holes on the inner peripheral side are deflected toward the expanding portion, and their contact area with the inner cylinder can be increased. By doing so, the Coanda effect of the jet stream is improved, and the tendency for separation on the downstream side of the passage turnaround position can be prevented.

In the above-mentioned aspect, the diameter of the holes on the inner peripheral side may be formed so as not to be smaller than an expansion height of the expanding portion.

By forming the diameter of the holes on the inner peripheral side so as not to be smaller than the expansion height of the expanding portion, the jet streams from the holes on the inner peripheral side are deflected toward the expanding portion, and their contact area with the inner cylinder can be increased. By doing so, the Coanda effect of the jet stream is improved, and the tendency for separation on the downstream side of the passage turnaround position can be prevented.

In the above-mentioned aspect, the distance between the centers of adjacent holes on the inner peripheral side may be not smaller than 1.5 times the diameter of the holes on the inner peripheral side.

When B stands for the diameter of the holes on the inner peripheral side, by regulating the distance between the centers of adjacent holes on the inner peripheral side to 1.5 B or more, the interference between the jet streams from adjacent holes is reduced, the Coanda effect of the jet streams can be maintained, and the tendency for separation on the downstream side of the passage turnaround position can be prevented. In addition, the jet stream generates a strong shearing force, which makes it possible to make the flow rate in the radial direction uniform.

In the above-mentioned aspect, the compressed air passage may be provided with a baffle plate functioning as the flow rate controller by blocking the passage, and the baffle plate may be provided, on the inner peripheral side, with a slit communicating between the upstream side and the downstream side of the baffle plate.

By providing a slit in the baffle plate that generates velocity defect, the flow rate is increased, and the flow rate in the radial direction can be made uniform. In addition, nonuniformity in flow rate is locally generated by this slit, increasing turbulence on the downstream side. As a result, momentum exchange is activated, and the tendency for separation on the downstream side of the passage turnaround position is also prevented.

A support rib for supporting the inner cylinder to the outer cylinder may be provided, and the baffle plate may be provided with a slit in the vicinity of the support rib to communicate between the upstream side and the downstream side of the baffle plate. In particular, the slit may be provided not only on the inner peripheral side of the baffle plate but also on the outer peripheral side or on the left and right sides of the support rib. Specific positions of the slits may be appropriately set according to the flow of compressed air.

In the above-mentioned aspect, the compressed air passage may be provided with a top hat nozzle at a position where the passage is turned in approximately the opposite direction.

More specifically, the mounting angle, i.e., the turning angle, of the top hat nozzle is 0 degree or more and less than 90 degrees, from the direction perpendicular to the passage direction of the main airflow toward the downstream side of the main airflow. In known technologies, a low-speed region is formed on the downstream side of the passage turnaround position due to, for example, separation. Consequently, in a structure in which the length of the combustor is short, the flow rectifying distance is shortened, showing a tendency of reducing flow rate on the inner peripheral side. However, in the present structure, the compressed air is mixed by the top hat nozzle disposed at the passage turnaround position to prevent separation of the flow. That is, momentum exchange is activated by eddies generated downstream of the top hat nozzle, and this has an effect of preventing generation of a separation region on the inner peripheral side when the passage is turned in the opposite direction.

In the above-mentioned aspect, the compressed air passage may be provided with a turning vane facing the edge of the inner cylinder to guide fluid in the passage that turns in the opposite direction, and the turning vane may be provided, on the back side thereof, with a stirrer for stirring the flow of the fluid.

The turning vane, as its function, reduces a loss in pressure by bending the fluid without causing separation. Such a fine flow is ideal, but since the generation of turbulence is small, the capability for mixing fuel is small. Therefore, in known combustors, the fuel concentration tends to be locally high on the downstream side of the fuel mixing position, and the NOx concentration is increased in some cases. In particular, it is believed that since the flow at the back side of the turning vane gently curves without causing separation, the turbulence on the back side of the turning vane is smaller than that on the front side, and the fuel mixing capability on the downstream side of the turning vane is weak. However, in the present structure, since the stirrer is disposed on the back side of the turning vane, the mixing of fuel on the downstream side is enhanced to make the fuel concentration uniform.

In the above-mentioned aspect, the turning vane may be provided with a slit communicating between the back side and the front side of the turning vane at the end on the downstream side thereof.

Since the flow on the front side of the turning vane tends to be directed toward the outer peripheral side due to the centrifugal force, a flow directed toward the outer peripheral side from the inner peripheral side of the turning vane is generated by providing the slit. As a result, the mixing on the back side of the turning vane is accelerated to make the fuel concentration uniform.

Advantageous Effects of Invention

According to the present invention, NOx reduction can be achieved while reducing the length in the axial direction of a combustor by preventing the separation of compressed air and making the fuel concentration uniform.

DESCRIPTION OF EMBODIMENTS

First Embodiment

Figure 1:
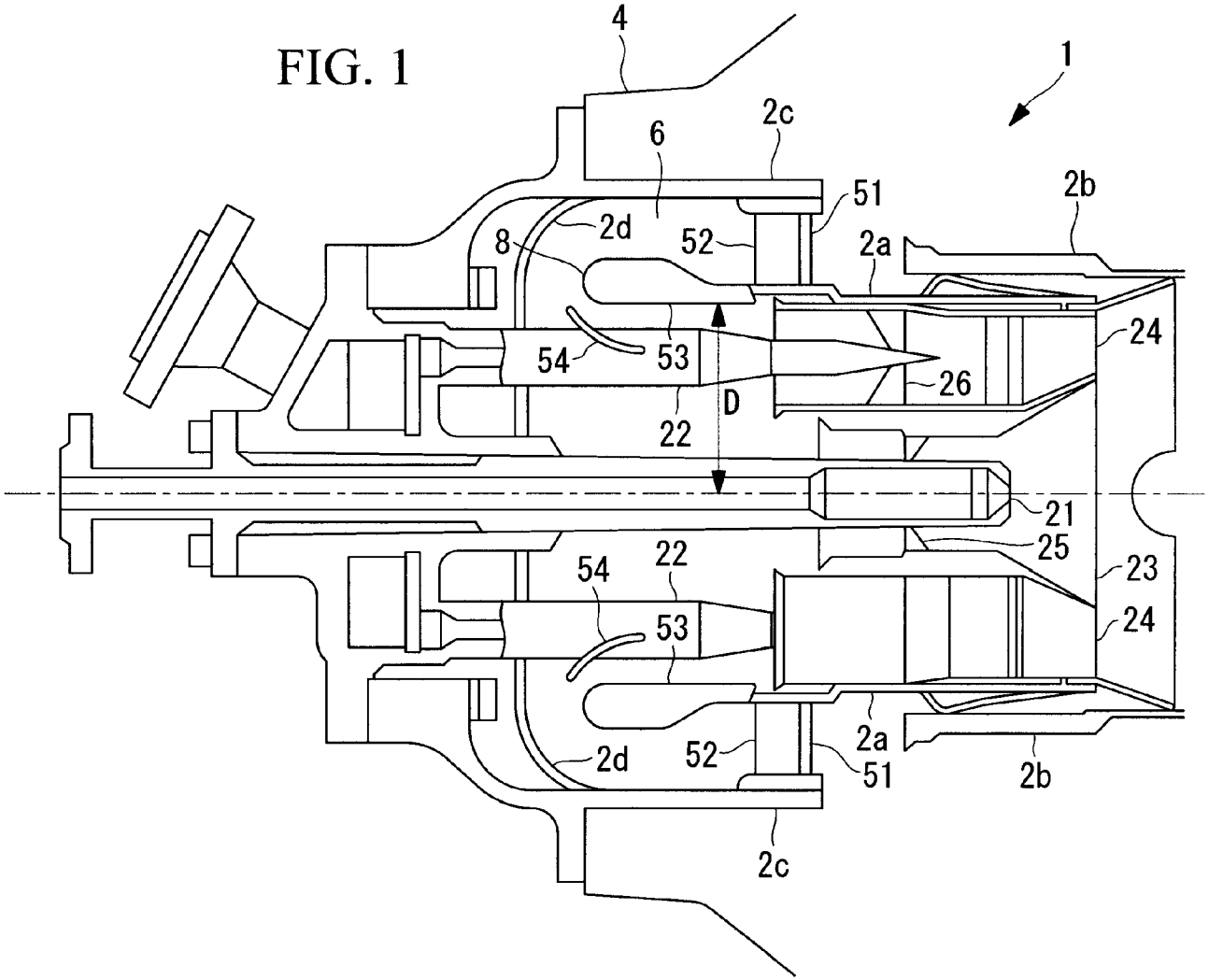
FIG. 1 is a cross-sectional view in a plane along the axis of a combustor according to a first embodiment of the present invention.

Next, embodiments of the present invention will be described with reference to the drawings.

First, a combustor according to a first embodiment will be described using FIG. 1. The combustor 1 in this embodiment includes, as shown in FIG. 1, a pilot nozzle 21 disposed along the axis of the combustor 1 for performing diffusion combustion, a plurality of main nozzles 22 arranged on the outer peripheral side of the pilot nozzle 21 at equal intervals in the circumferential direction for performing premixed combustion, a pilot cone 23 disposed so as to cover the distal end of the pilot nozzle 21, main burners 24 disposed so as to cover the distal ends of the main nozzles 22, a pilot swirler 25 disposed between the outer wall of the pilot nozzle 21 and the inner wall of the pilot cone 23, and a main swirler 26 disposed between the outer walls of the main nozzles 22 and the inner walls of the main burners 24.

Furthermore, the combustor shown in FIG. 1 includes an inner cylinder 2*a* that is approximately coaxial with the pilot nozzle 21 and is formed so as to entirely cover the pilot nozzle 21 and main nozzles 22, a transition piece 2*b* that is fitted in the inner cylinder 2*a* and guides fuel gas from the pilot nozzle 21 and the main nozzles 22 to the turbine side (not shown), an outer cylinder 2*c* that is approximately coaxial with the inner cylinder 2*a* and coaxially surrounds the outer side of the inner cylinder 2*a*, and a back wall 2*d* that closes the downstream end of the outer cylinder 2*c*.

Figure 2:
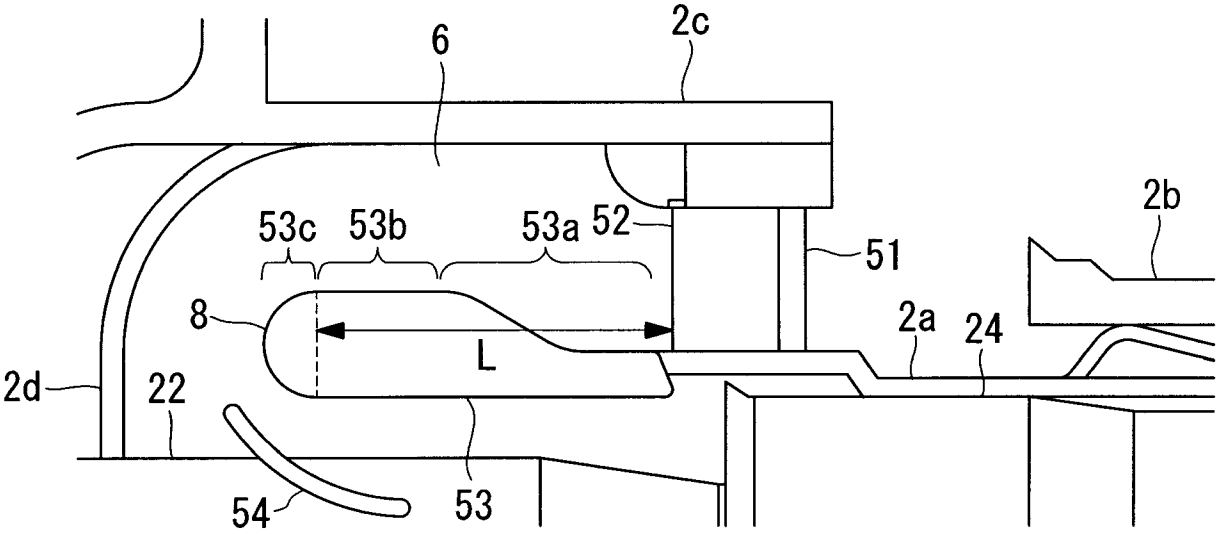
FIG. 2 is a partially enlarged view illustrating the vicinity of a 180-degree turning portion in FIG. 1.

The inner cylinder 2*a* and the outer cylinder 2*c* form a compressed air passage 6 therebetween. The inner cylinder 2*a* has a 180-degree turning portion (expanding portion) 8 that turns the passage direction of the compressed air passage 6 in approximately the opposite direction so that the compressed air passage 6 turns to the inner side of the inner cylinder 2*a* at the end of the inner cylinder 2*a*. The outer wall of the 180-degree turning portion 8 in the radial direction expands outward in the radial direction, and the portion corresponding to the edge of the inner cylinder 2*a*, as shown in FIG. 1, becomes a smooth curve connecting the outer peripheral surface and the inner peripheral surface of the inner cylinder 2*a* in a cross-section of a plane containing the axis of the combustor 1. In more detail, as shown in FIG. 2, the 180-degree turning portion 8 includes a tapered portion 53*a* in which the distance from the inner wall of the outer cylinder 2*c* is decreased from the end on the upstream side toward the downstream side, a flat portion 53*b* in which the distance from the inner wall of the outer cylinder 2*c* is constant on the downstream side of the tapered portion, and a semicircular portion 53*c* having an approximately semicircular cross-section at the end on the downstream side. The slope starting portion on the upstream side of the tapered portion 53*a* and the connection portion between the tapered portion 53*a* and the flat portion 53*b* have smoothly rounded shapes.

By constructing the 180-degree turning portion 8 in this way, the outer wall of the 180-degree turning portion 8 is configured so as to come close to the inner peripheral surface of the outer cylinder 2*c* toward the downstream side. Consequently, the cross-section of the compressed air passage formed between the inner peripheral surface of the outer cylinder 2*c* and the outer peripheral surface of the 180-degree turning portion 8 is gradually narrowed toward the downstream end. By doing so, the flow of the compressed air is narrowed, and the flow on the downstream side of the 180-degree turning portion 8 is made uniform in the circumferential direction of the combustor.

In addition, as shown in the cross-sectional view in FIG. 1, the back wall 2*d* has an arc-shaped portion formed of a curved surface farther toward the outer peripheral side than the 180-degree turning portion 8 and a flat portion that is flat farther toward the inner peripheral side than the 180-degree turning portion 8 and thereby forms an inner wall having a concave surface with a conical shape. At this point, the curvature of the arc-shaped portion is adjusted according to the outer peripheral surface of the semicircular portion 53*c* of the 180-degree turning portion 8 so that the distance between the inner wall of the arc-shaped portion of the back wall 2*d* and the outer wall of the semicircular portion 53*c* of the 180-degree turning portion 8 is constant. In addition, the connection portion of the arc-shaped portion and the flat portion of the back wall 2*d* is formed on a line extending in the axial direction from the end on the downstream side of the semicircular portion 53*c* of the 180-degree turning portion 8.

By constituting the back wall 2*d* in this way, the cross-sectional area defined by the inner wall of the arc-shaped portion of the back wall 2*d* and the outer wall of the semicircular portion 53*c* of the 180-degree turning portion 8 can be made constant and can be adjusted to the same area as the cross-sectional area defined by the inner wall of the outer cylinder 2*c* and the flat portion 53*b* of the 180-degree turning portion 8. By doing so, the compressed air flowing between the outer wall of the 180-degree turning portion 8 and the inner wall of the outer cylinder 2*c* can be smoothly guided toward the inner side of the 180-degree turning portion 8.

A baffle plate (flow rate controller) 51 is disposed inside the compressed air passage 6 in the vicinity of the inlet. The baffle plate 51 is a ring-like member covering the upstream side of the outer cylinder 2*c* inside the compressed air passage 6 and is a porous plate provided with a large number of holes that communicate between the upstream side and the downstream side of the baffle plate 51 in the compressed air passage 6. A plurality of ribs 52 for fixing the baffle plate 51 are disposed in the vicinity of the downstream side of the baffle plate 51 at equal intervals in the circumferential direction. The inner cylinder 2*a* is fixed to the inner side of the outer cylinder 2*c* by connecting these ribs 52 to the outer wall of the inner cylinder 2*a* and the inner wall of the outer cylinder 2*c*. As shown in the front view in FIG. 3A, the ribs 52 are disposed in a radial fashion around the axis of the combustor so that the both ends are respectively in contact with the outer wall of the inner cylinder 2*a* and the inner wall of the outer cylinder 2*c*. The number of ribs 52 is more than one, and the inner cylinder 2*a* is supported by arranging the plurality of ribs 52 at equal intervals in the circumferential direction of the combustor and connecting the ribs 52 to the outer cylinder 2*c*.

Figure 3A:
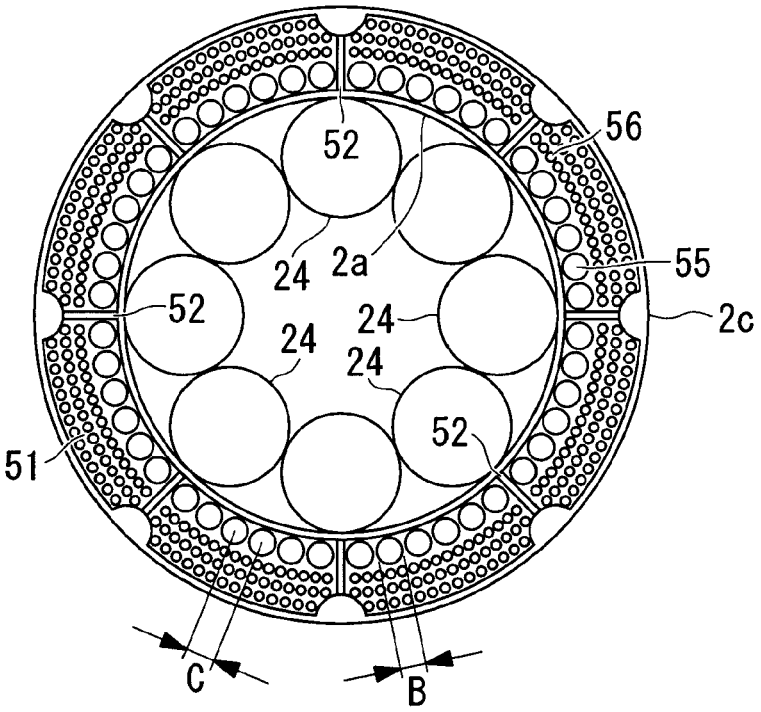
FIG. 3A shows a baffle plate of the combustor and is a diagram viewed from the axial direction.
Figure 3B:
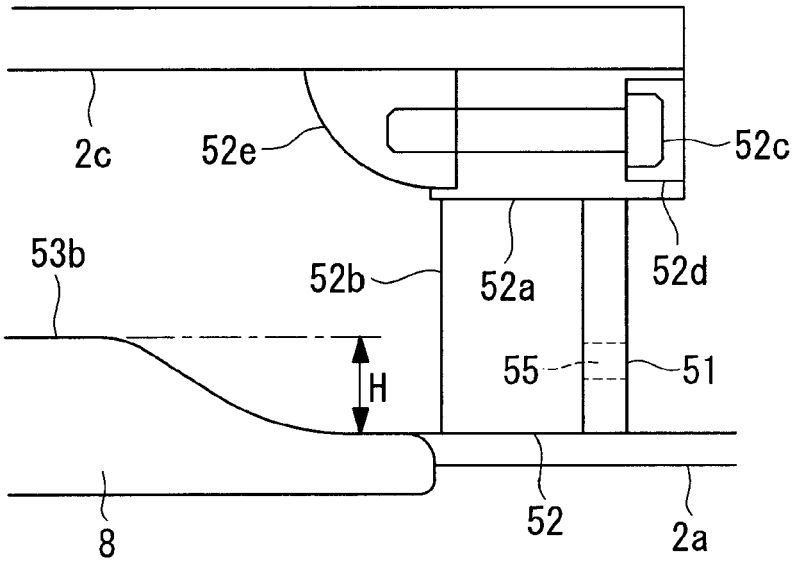
FIG. 3B shows the baffle plate of the combustor and is a partially enlarged view of FIG. 1.

As shown in the cross-sectional view in FIG. 3B, the ribs 52 each include a fixing member 52*a* connected to the outer peripheral side of the baffle plate 51 and a plate member 52*b* formed so as to protrude from the fixing member 52*a* to the inner cylinder 2*a* and being in contact with the inner cylinder 2*a*. The fixing member 52*a* has a columnar structure having a semicircular cross-section and protruding to both the upstream side and the downstream side of the baffle plate 51 and is provided with a penetrating threaded hole in which a bolt 52*c* is inserted. On the upstream side of the fixing member 52*a*, a concave portion 52*d* is provided so that the head portion of the bolt 52*c* is hidden therein and is filled with a metal component after insertion of the bolt 52*c* to form a flat end surface.

Furthermore, as shown in the cross-sectional view in FIG. 3B, the outer cylinder 2*c* includes, on its inner wall, a rib-connecting member 52*e*, which is connected to the fixing member 52*a* of the rib 52 and is approximately columnar in the axis direction. This rib-connecting member 52*e* has a threaded hole in which the bolt 52*c* is inserted. By doing so, the bolt 52*c* passing through the threaded hole of the fixing member 52*a* is inserted in the threaded hole of the rib-connecting member 52*e* to fix the fixing member 52*a* to the rib-connecting member 52*e*, and thereby the baffle plate 51 and the rib 52 are fixed to the outer cylinder 2*c*. In addition, by forming the end surface on the downstream side as an approximately quarter-sphere curved surface, turbulence of compressed air flow can be prevented from occurring as much as possible.

By providing the ribs 52 fixed to the outer cylinder 2*c* in a radial fashion in this way, the inner cylinder 2*a* can be pressed in the circumferential direction and fixed by the ribs 52. By doing so, the end on the downstream side of the main nozzle 22 can be supported by the main swirler 26 of the main burner 24 connected to the inner cylinder 2*a*. Consequently, the compressed air flowing in the inner cylinder 2*a* is made uniform by the structure composed of the back wall 2*d* and the 180-degree turning portion 8 described above and a turning vane 54 described below. Accordingly, since the lengths in the axial direction of the pilot nozzle 21 and the main nozzles 22 can be shortened, a pillar connected to the pilot nozzle 21 supporting the downstream sides of the main nozzles 22 is unnecessary. Furthermore, since the compressed air is made into a uniform flow, the resistance of the baffle plate 51 can be smaller than one in the related art, and a loss in pressure due to the baffle plate 51 can be prevented.

A ring-like turning vane 54 is disposed in the vicinity of the end on the upstream side of the inner cylinder 2*a* so as to cover the region between the main nozzles 22. The turning vane 54 is arranged inside the inner cylinder 2*a* in the vicinity of the 180-degree turning portion 8 and is formed of one plate inflected from the side farther toward the outer side than the main nozzles 22 in the radial direction up to the axial position of the main nozzles 22, from the upstream side toward the downstream side. In addition, the curvature of the turning vane 54 is adjusted so as to be comparable to that of the inner wall of the semicircular portion 53*c* of the 180-degree turning portion 8. Furthermore, this turning vane 54 is formed as an arc-shaped plate connected to the side face of the main nozzle 22. The compressed air turned by 180 degrees along the 180-degree turning portion 8 and the back wall 2*d* is guided to the pilot cone 23 and the main burner 24 by the thus-configured turning vane 54.

By constructing the back wall 2*d*, the 180-degree turning portion 8, and the turning vane 54 as described above, the compressed air flowing into the region between the outer cylinder 2*c* and the 180-degree turning portion 8 is rectified by the tapered portion 53*a* of the 180-degree turning portion 8 and is then turned by 180 degrees by the 180-degree turning portion 8. Subsequently, the air is rectified by the turning vane 54 and is guided to the pilot cone 23 and the main burner 24.

Next, the baffle plate 51 serving as a characteristic structure in this embodiment will be described. As shown in the front view viewed from the downstream side of the outer cylinder 2*c* in FIG. 3A, the baffle plate 51 has a ring-like structure covering the inlet of the compressed air passage 6 between the outer wall of the inner cylinder 2*a* and the inner wall of the outer cylinder 2*c* and is provided with a large number of holes passing therethrough in the axial direction. As shown in FIG. 3A, the diameter of the holes 55 on the inner peripheral side is larger than that of the holes 56 formed on the outer peripheral side. That is, it is configured so that the main airflow rate on the inner peripheral side is larger than that on the outer peripheral side.

Figure 4:
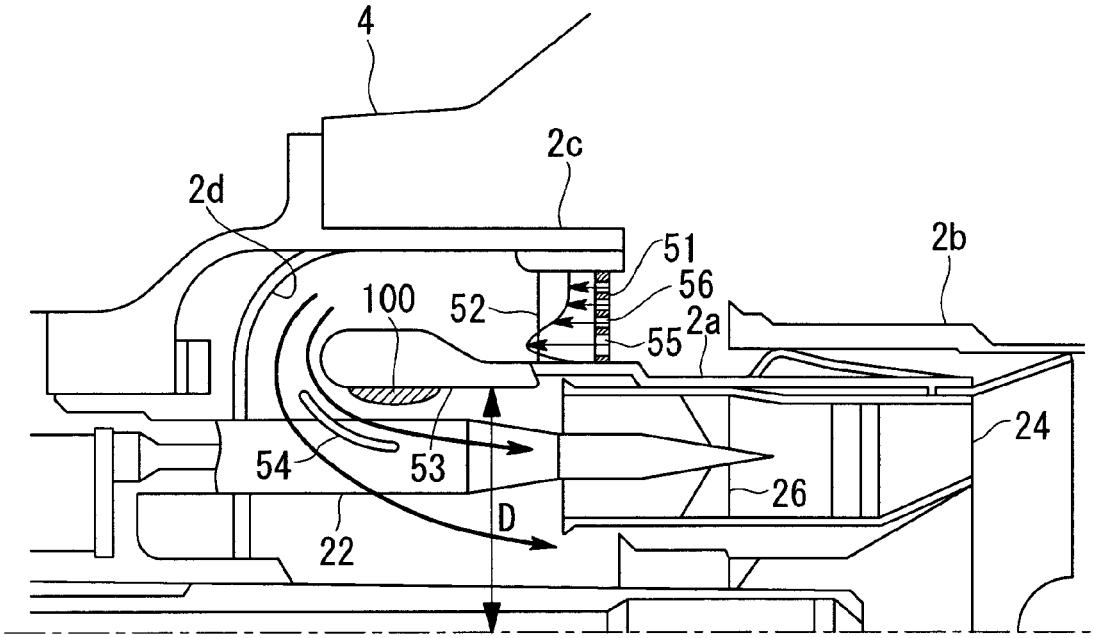
FIG. 4 is a cross-sectional view illustrating a main airflow when the baffle plate is used.

FIG. 4 shows the main airflow when the baffle plate 51 according to this embodiment is used. When a baffle plate is provided with uniform holes, as in a known one, the flow does not have a distribution in the radial direction of the combustor 1. The flow turned at the 180-degree turning portion 8 in such a state, as shown by reference numeral 100 in FIG. 4, forms a low-speed region due to, for example, separation. Consequently, in a structure in which the length of the combustor is short, the flow rectifying distance is shortened to show a tendency of reducing the flow rate on the inner peripheral side.

In the baffle plate 51 according to this embodiment, the holes 55 having a large diameter are provided on the inner peripheral side to increase the flow rate on the inner peripheral side and make the flow rate uniform in the radial direction. That is, the baffle plate 51 of this embodiment functions as a flow rate controller.

In addition, by arranging large holes and small holes in a mixed fashion, nonuniformity in flow rate is locally generated, increasing turbulence on the downstream side of the large holes. As a result, momentum exchange is activated, and the tendency for separation at the 180-degree turning portion 8 is also prevented.

Thus, according to the combustor of this embodiment, a flow rate distribution in the radial direction is provided, and separation is prevented by accelerating turbulence. As a result, uniformity and miscibility of the main airflow rate in the radial direction in the downstream region of the 180-degree turning portion 8 (the upstream region of the main premixing nozzle) can be improved. By doing so, NOx can be reduced.

Furthermore, as shown in FIG. 2, the baffle plate 51 may be disposed at a position a distance L, on the upstream side, from the center of the position at which the compressed air passage 6 is turned in approximately the opposite direction, that is, the center of the semicircular portion 53. Here, the distance L is, for example, a distance of 5 B or more and 15 B or less, where B stands for the diameter of the holes 55 on the inner peripheral side (large pore size).

The distance that maintains the core portion of a jet stream passing through the baffle plate 51, that is, the region in which the flow rate of the jet stream is not decreased by the influence of fresh air, is about 6 B from the baffle plate 51 to the downstream side in a two-dimensional jet stream, and about 10 B from the baffle plate 51 to the downstream side in a three-dimensional jet stream. Accordingly, by disposing the baffle plate 51 at a position, on the upstream side of the center of the position at which the compressed air passage 6 is turned in approximately the opposite direction, at the above-mentioned distance L, the Coanda effect of the jet stream can be expected, and the tendency for separation on the downstream side of the passage turnaround position can be prevented.

In addition, as shown in FIG. 3B, at least some of the holes 55 on the inner peripheral side (large pore size) may be disposed farther toward the inner side in the radial direction than the end of the 180-degree turning portion 8 on the outer side in the radial direction (the end of the flat portion 53*b*).

By providing the inner-periphery holes 55 farther toward the inner side in the radial direction than the end of the flat portion 53*b*, the jet streams from the holes 55 on the inner peripheral side are deflected toward the 180-degree turning portion 8, and their contact area with the inner cylinder 2*a* can be increased. By doing so, the Coanda effect of the jet stream is improved, and the tendency for separation on the downstream side of the passage turnaround position can be prevented.

Furthermore, as shown in FIG. 3B, the diameter B of the holes 55 on the inner peripheral side (large pore size) may be formed so as not to be smaller than the expansion height H of the 180-degree turning portion 8.

By forming the diameter B of the holes 55 on the inner peripheral side so as not to be smaller than the expansion height H of the 180-degree turning portion 8, the jet streams from the holes 55 on the inner peripheral side are deflected toward the 180-degree turning portion 8, and their contact area with the inner cylinder 2*a* can be increased. By doing so, the Coanda effect of the jet stream is improved, and the tendency for separation on the downstream side of the passage turnaround position can be prevented.

Furthermore, as shown in FIG. 3A, the distance C between the centers of adjacent holes 55 on the inner peripheral side (large pore size) may be 1.5 times the diameter B of the holes 55 on the inner peripheral side or larger.

By regulating the distance C between the centers of adjacent holes 55 on the inner peripheral side to 1.5 B or more, that is, the gap between adjacent holes 55 on the inner peripheral side to 0.5 B or more, interference between the jet streams from the adjacent holes 55 is reduced, the Coanda effect of the jet streams can be maintained, and the tendency for separation on the downstream side of the passage turnaround position can be prevented. In addition, the jet stream generates a strong shearing force, which allows the flow rate in the radial direction to be made uniform.

Note that in the above-described embodiment, though the pore size on the inner peripheral side of the baffle plate 51 is larger than that on the outer peripheral side, instead of the inner peripheral side or together with the inner peripheral side, the pore size on the outer peripheral side may be large. Alternatively, pressure loss control may be performed by varying the thickness of the baffle plate 51.

Second Embodiment

Next, a second embodiment of the present invention will be described. Note that the overall configuration is similar to that of the first Embodiment and that the same configurations are designated with the same reference numerals and, descriptions thereof are omitted.

Figure 5:
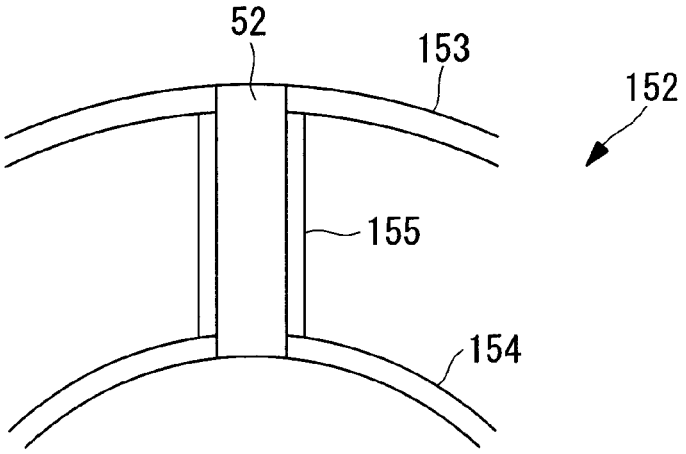
FIG. 5 is a partial plan view of a baffle plate used in a combustor according to a second embodiment of the present invention.

FIG. 5 shows a partial front view of a baffle plate 152 according to this embodiment. The baffle plate 152 of this embodiment is ring-shaped and is provided with an outer slit 153 along the outer peripheral edge as a gap with respect to the outer cylinder 2*c* and an inner slit 154 along the inner peripheral edge as a gap with respect to the inner cylinder 2*a*. The outer slit 153 and the inner slit 154 are passages passing through the baffle plate 152 in the axial direction of the flow path. In addition, rib-neighboring-slits 155 disposed on both sides of the rib 52 are passages passing through the baffle plate 152 in the axial direction of the flow path and are disposed over the entire length in the radial direction.

Figure 6:
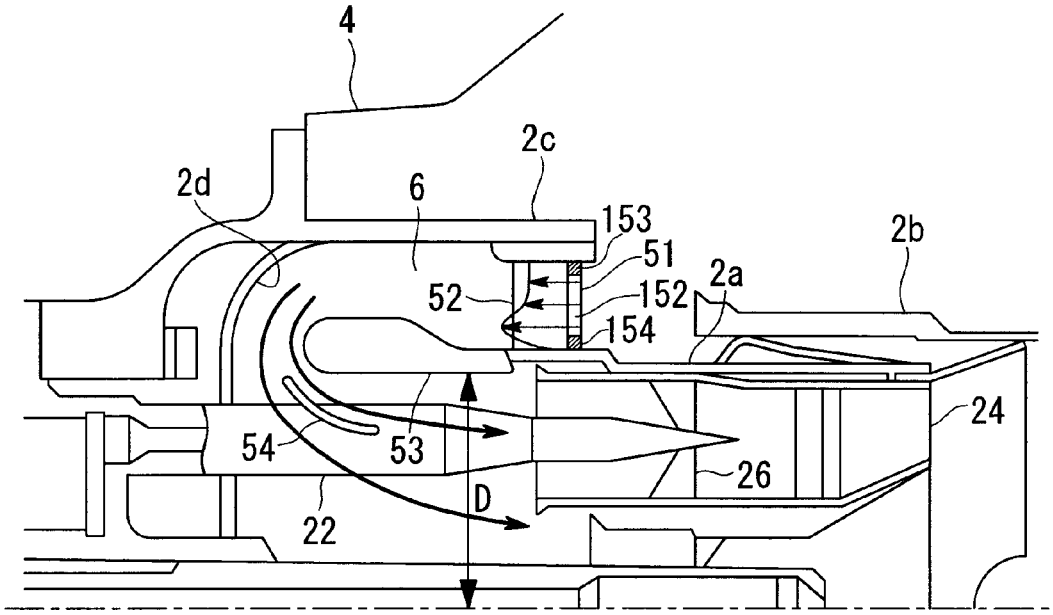
FIG. 6 is a cross-sectional view illustrating a main airflow when the baffle plate is used.

FIG. 6 shows a main airflow when the baffle plate 152 according to this embodiment is used. If a baffle plate 152 is provided with uniform holes, as in a known one, the momentum supplied to velocity defect regions formed downstream of structures such as low-speed regions in the vicinity of the walls and the ribs 52 is insufficient. Consequently, the flow turned at the 180-degree turning portion 8 in a state having velocity defects in the vicinity of the walls and the ribs 52 is nonuniform and induces a difference in the fuel concentration, which deteriorates the combustion stability and exhaust gas characteristics.

In this embodiment, by providing slits on the inner and outer peripheral sides of the baffle plate 152 and in the vicinity of the ribs 52 where velocity defects will occur, the flow rate is increased, solving the above-mentioned problems. In addition, nonuniformity in the flow rate is locally generated by these slits, increasing turbulence on the downstream side. As a result, momentum exchange is brought about, and the tendency for separation at the 180-degree turning portion 8 is also prevented.

Thus, according to the combustor of this embodiment, the slits are provided in the baffle plate 152 according to this embodiment, thus achieving elimination of velocity defects that occur in the vicinity of walls and supports in the baffle plate 152. As a result, uniformity of the main airflow rate and miscibility in the downstream region of the 180-degree turning portion 8 (the upstream region of the main premixing nozzle) can be improved.

Furthermore, in particular, the inner slit 154 may be provided only on the inner peripheral side of the baffle plate. The specific position where the slit is provided may be appropriately determined according to the flow of compressed air.

Third Embodiment

Next, a third embodiment of the present invention will be described. Note that the overall configuration is similar to that of the first Embodiment and that the same configurations are designated with the same reference numerals, and descriptions thereof are omitted.

Figure 7:
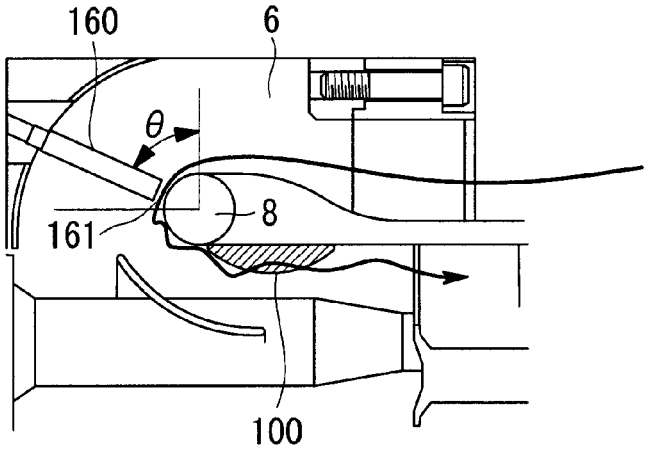
FIG. 7 is a cross-sectional view illustrating the vicinity of a top hat nozzle used in a combustor according to a third embodiment of the present invention.

As shown in FIG. 7, a top hat nozzle 160 is disposed in the middle of the 180-degree turning portion. A plurality of the top hat nozzles 160 are disposed farther on the outer peripheral side than the main nozzles 22 and function as premixed combustion fuel nozzles for mixing top hat fuel gas and compressed air farther on the upstream side compared with the main nozzles 22 and then combusting them in order to reduce NOx and the like.

The inner peripheral portion of the 180-degree turning portion 8 partially has a circular shape in the cross section along the axis of the combustor, as shown in the drawing, and smoothly turns the direction of the passage by 180 degrees. In this embodiment, the top hat nozzle 160 is a cylinder with a diameter of 10 mm and is disposed along the radial direction of the circular shape of the semicircular portion 53*c*, and the gap 161 is formed between the end of the inner side (discharge side) of the top hat nozzle 160 and the turning inner peripheral portion.

The nozzle placement position needs to be farther on the upstream side than the separation point described below, and the mounting angle, i.e., the turning angle with respect to the 180-degree turning portion 8, is θ (0 degree or more and less than 90 degrees), from the direction perpendicular to the passage direction of the main airflow toward the downstream side of the main airflow. The size of the gap 161 is about 0.5 to 2.0 times the diameter Dp of the top hat nozzle.

In known technologies, the top hat nozzle has been disposed at the intermediate region between the baffle plate and the 180-degree turning portion 8. In known technologies, the flow that has turned at the 180-degree turning portion 8, as shown by reference numeral 100 in FIG. 7, forms a low-speed region due to, for example, separation. Consequently, in a structure in which the length of the combustor is short, the flow rectifying distance is shortened, showing a tendency of reducing flow rate on the inner peripheral side.

In this embodiment, separation of the flow is prevented through the mixing effect by the top hat nozzle 160. That is, momentum exchange is activated by eddies generated downstream of the top hat nozzle 160, and this has an effect of preventing generation of a separation region at the turning inner peripheral portion of the 180-degree turning portion 8 where the direction changes considerably. Furthermore, by appropriately maintaining the gap 161 between the top hat nozzle 160 and the turning inner peripheral portion within the above-mentioned range, the turbulence from the gap more effectively prevents a separation region from occurring downstream of the turning inner peripheral portion. In addition, by disposing the top hat nozzle 160 in the middle of the 180-degree turning portion 8, the distance between the baffle plate and the 180-degree turning portion 8 can be shortened, and the combustor can be reduced in size by unifying the functions of the top hat nozzle 160 and the 180-degree turning portion 8.

Fourth Embodiment

Next, a fourth embodiment of the present invention will be described. Note that the overall configuration is similar to that of the first Embodiment and that the same configurations are designated with the same reference numerals, and descriptions thereof are omitted.

Figure 8:
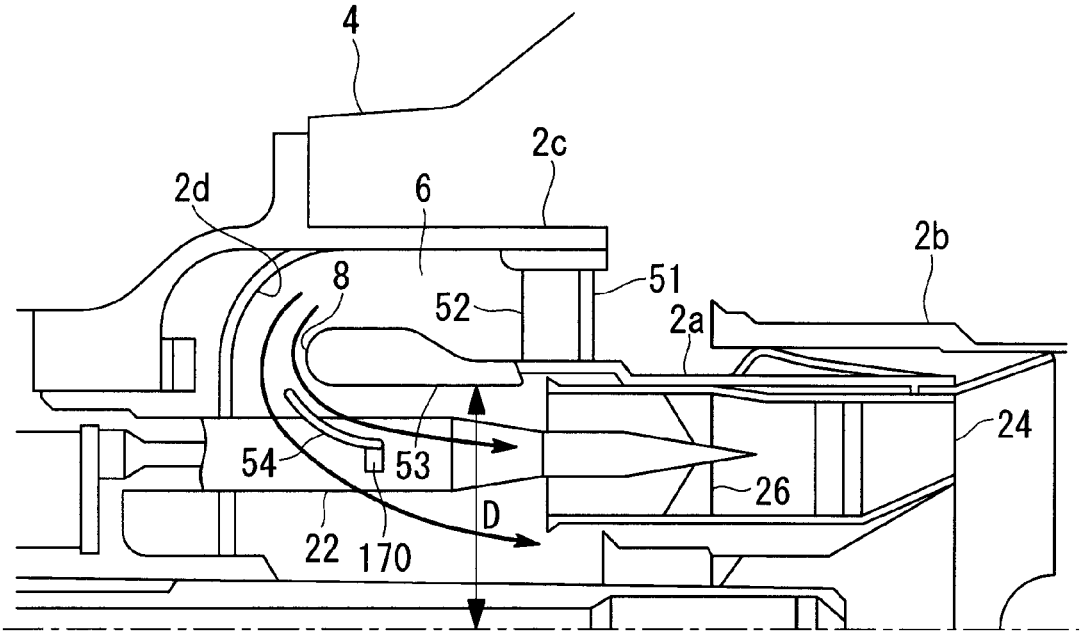
FIG. 8 is a cross-sectional view illustrating the vicinity of a stirrer used in a combustor according to a fourth embodiment of the present invention.

As shown in FIG. 8, the turning vane 54 is provided with pin-like stirrers 170 protruding to the inner side in the radial direction on the back side (that is, on the outer side in the radial direction of the compressed air passage 6 that turns the direction by 180 degrees). The plurality of stirrers 170 are disposed in a distributed manner at approximately equal intervals along the circumferential direction.

The turning vane 54 functions to reduce a loss in pressure by bending the fluid without causing separation. Such a fine flow is ideal, but since the generation of turbulence is small, the capability that mixes the fuel is small. Therefore, in known combustors, the fuel concentration tends to be locally high on the downstream side of the fuel mixing position, and the NOx concentration is increased in some cases. In particular, it is believed that since the flow at the back side of the turning vane 54 gently curves without causing separation, the turbulence is smaller than that on the front side of the turning vane 54, and the fuel mixing capability on the downstream side thereof is weak.

However, in this embodiment, by disposing the pin-shaped stirrers 170 on the back side of the turning vane 54, the mixing of fuel on the downstream side is enhanced, making the fuel concentration uniform. As a result, NOx reduction can be achieved.

Fifth Embodiment

Next, a fifth embodiment of the present invention will be described. Note that the overall configuration is similar to that of the first Embodiment and that the same configurations are designated with the same reference numerals, and descriptions thereof are omitted.

In this embodiment, as in the fourth embodiment, fuel mixing of the flow at the back side of a turning vane is enhanced by increasing turbulence at the back side of the turning vane.

Figure 9A:
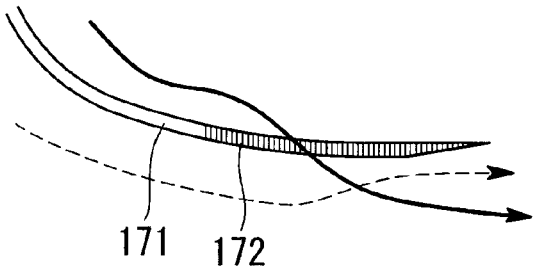
FIG. 9A is a vertical cross-sectional view illustrating a turning vane used in a combustor according to a fifth embodiment of the present invention.
Figure 9B:
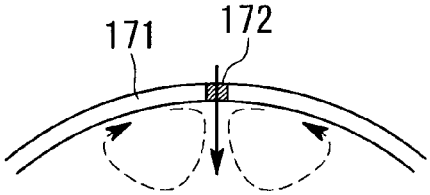
FIG. 9B is a horizontal cross-sectional view illustrating the turning vane used in the combustor according to the fifth embodiment of the present invention.

That is, as shown in FIGS. 9A and 9B, the end on the downstream side of the turning vane 171 of this embodiment is provided with notches (slits) 172 along the passage direction. The plurality of notches 172 communicate between the front side and the back side of the turning vane 171 and are disposed at intervals along the circumferential direction of the turning vane 171. Other structures of the turning vane 171 are the same as those of the turning vane 54 of the first embodiment, and the descriptions thereof are omitted.

Since the flow at the front side of the turning vane 171 tends to be directed toward the outer peripheral side due to the centrifugal force, by providing the notches 172, a flow directed toward the outer peripheral side from the inner peripheral side of the turning vane is generated. As a result, like the flows shown by arrows in FIGS. 9A and 9B, the mixing on the back side of the turning vane is enhanced, making the fuel concentration uniform. As a result, NOx reduction can be achieved.

REFERENCE SIGNS LIST

1 combustor
2*a* inner cylinder
2*c* outer cylinder
6 compressed air passage
8 180-degree turning portion (expanding portion)
51 baffle plate (flow rate controller)
52 rib
54 turning vane
55 hole
56 hole
152 baffle plate
153 outer slit
154 inner slit
155 rib-neighboring-slit
160 top hat nozzle
170 stirrer
171 turning vane
172 notch (slit)

The invention claimed is:

1. A combustor comprising: a pilot nozzle disposed along a central axis of the combustor and performing diffusion combustion; a plurality of main nozzles disposed on an outer peripheral side of the pilot nozzle at intervals in a circumferential direction and performing premixed combustion; a single inner cylinder surrounding the pilot nozzle and the main nozzles; and an outer cylinder approximately coaxially surrounding an outer side of the inner cylinder to form a compressed air passage between an inner peripheral surface thereof and an outer peripheral surface of the inner cylinder and turning a flow direction of compressed air flowing in the compressed air passage in approximately an opposite direction at an end of the inner cylinder to introduce the compressed air into the pilot nozzle, wherein the compressed air passage is provided with a flow rate controller that makes a flow rate on an inner peripheral side to a position at which the compressed air passage is turned in approximately the opposite direction larger than that on an outer peripheral side, wherein the flow rate controller is disposed on an upstream side, in a flow direction of the compressed air, of a center of the position at which the compressed air passage is turned in approximately the opposite direction, wherein fuel is mixed on a downstream side of the flow rate controller in the flow direction of the compressed air, wherein the compressed air passage is provided with a baffle plate functioning as the flow rate controller by blocking the passage, and wherein the baffle plate is a ring-shaped flat plate, and the baffle plate is provided with a plurality of holes communicating between an upstream side and a downstream side, in the flow direction of the compressed air, of the baffle plate in the passage, wherein a diameter of the holes provided on the outer peripheral side is smaller than the diameter of the holes provided on the inner peripheral side.

2. The combustor according to claim 1, wherein the baffle plate is disposed at a position, on the upstream side of the center of the position at which the passage is turned in approximately the opposite direction, with a distance from the center not longer than 15 times the diameter of the holes provided on the inner peripheral side.

3. The combustor according to claim 1, wherein the end of the inner cylinder is provided with an expanding portion gradually expanding outward in the radial direction toward the downstream end of the passage; and the holes on the inner peripheral side are disposed farther toward an inner side in the radial direction than an edge of the expanding portion on an outer side in the radial direction.

4. The combustor according to claim 3, wherein the diameter of the holes on the inner peripheral side is formed so as not to be smaller than an expansion height of the expanding portion.

5. The combustor according to claim 1, wherein the distance between the centers of adjacent holes on the inner peripheral side is not smaller than 1.5 times the diameter of the holes on the inner peripheral side.

6. A combustor comprising: a pilot nozzle disposed along a central axis of the combustor and performing diffusion combustion; a plurality of main nozzles disposed on an outer peripheral side of the pilot nozzle at intervals in a circumferential direction and performing premixed combustion; a single inner cylinder surrounding the pilot nozzle and the main nozzles; and an outer cylinder approximately coaxially surrounding an outer side of the inner cylinder to form a compressed air passage between an inner peripheral surface thereof and an outer peripheral surface of the inner cylinder and turning a flow direction of compressed air flowing in the compressed air passage in approximately an opposite direction at an end of the inner cylinder to introduce the compressed air into the pilot nozzle, wherein the compressed air passage is provided with a flow rate controller that makes a flow rate on an inner peripheral side to a position at which the compressed air passage is turned in approximately the opposite direction larger than that on an outer peripheral side, wherein the flow rate controller is disposed on an upstream side, in a flow direction of the compressed air, of a center of a position at which the compressed air passage is turned in approximately the opposite direction, wherein fuel is mixed on a downstream side of the flow rate controller in the flow direction of the compressed air, wherein the compressed air passage is provided with a baffle plate functioning as the flow rate controller by blocking the passage; and wherein the baffle plate is a ring-shaped flat plate, and the baffle plate is provided, on the inner peripheral side, with a slit communicating between the upstream side and the downstream side of the baffle plate in the flow direction of the compressed air, the slit is formed along the inner peripheral edge of the baffle plate as a gap with respect to the inner cylinder.

7. The combustor according to claim 1, wherein the compressed air passage is provided with a top hat nozzle at a position where the passage is turned in approximately the opposite direction.

8. The combustor according to claim 1, wherein the compressed air passage is provided with a turning vane facing an edge of the inner cylinder to guide fluid in the passage that turns in the opposite direction; and the turning vane is provided, on a back side thereof, with a stirrer for stirring the flow of the fluid.

9. The combustor according to claim 8, wherein the turning vane is provided with a slit communicating between the back side and a front side of the turning vane at an end on a downstream side thereof.

10. The combustor according to claim 1, wherein the baffle plate is disposed at the position, on the upstream side of the center of the position at which the passage is turned in approximately the opposite direction, with a distance from the center being at least 5 times the diameter of the holes provided on the inner peripheral side and not longer than 15 times the diameter of the holes provided on the inner peripheral side.

11. The combustor according to claim 1, wherein said ring-shaped flat baffle plate has an annular planar surface on a downstream side of said baffle plate and said plurality of holes each have substantially uniform shapes across a width of said baffle plate with central axes of said plurality of holes extending substantially parallel to said flow direction of the compressed air and substantially perpendicular to said annular planar surface.

12. The combustor according to claim 6, wherein said ring-shaped flat baffle plate has an annular planar surface on a downstream side of said baffle plate and said plurality of holes each have substantially uniform shapes across a width of said baffle plate with central axes of said plurality of holes extending substantially parallel to said flow direction of the compressed air and substantially perpendicular to said annular planar surface.

* * * * *